US008898931B2

(12) United States Patent
Gerber

(10) Patent No.: US 8,898,931 B2
(45) Date of Patent: Dec. 2, 2014

(54) FOLDED LOOP FASTENING SYSTEM FOR AN ARTICLE OF FOOTWEAR

(75) Inventor: Clifford B. Gerber, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 718 days.

(21) Appl. No.: 13/188,588

(22) Filed: Jul. 22, 2011

(65) Prior Publication Data

US 2013/0019501 A1 Jan. 24, 2013

(51) Int. Cl.
*A43C 1/04* (2006.01)

(52) U.S. Cl.
CPC ..... *A43C 1/04* (2013.01)
USPC ..... 36/50.1; 24/714.7

(58) Field of Classification Search
USPC ..... 36/50.1; 24/713.6, 714.6, 714.7
See application file for complete search history.

(56) References Cited

U.S. PATENT DOCUMENTS

| | | | | |
|---|---|---|---|---|
| 371,394 | A | 10/1887 | Warren | |
| 442,552 | A * | 12/1890 | Stone | 450/141 |
| 712,003 | A * | 10/1902 | Payne | 24/714.7 |
| 996,468 | A * | 6/1911 | De Haven | 24/439 |
| 1,108,796 | A * | 8/1914 | Schell | 2/128 |
| 2,316,102 | A | 4/1943 | Preston | |
| 2,369,254 | A * | 2/1945 | Roman | 36/50.1 |
| 2,406,528 | A * | 8/1946 | Blair | 450/141 |
| 2,511,437 | A | 6/1950 | Krispert | |
| 4,756,098 | A | 7/1988 | Boggia | |
| 6,128,835 | A | 10/2000 | Ritter et al. | |
| 7,624,517 | B2 | 12/2009 | Smith | |
| 7,703,220 | B2 | 4/2010 | Aveni | |
| 7,774,956 | B2 | 8/2010 | Dua et al. | |
| 2002/0166260 | A1 * | 11/2002 | Borsoi | 36/50.1 |
| 2004/0181972 | A1 | 9/2004 | Csorba | |
| 2008/0016717 | A1 * | 1/2008 | Ruban | 36/21 |
| 2009/0277043 | A1 * | 11/2009 | Graser et al. | 36/91 |

* cited by examiner

*Primary Examiner* — Marie Bays
(74) *Attorney, Agent, or Firm* — Plumsea Law Group, LLC

(57) ABSTRACT

A lacing element for a fastening system of an article of footwear is formed using a continuous strip of material that is folded across itself in a series of different directions to produce a plurality of folded loops. A first group of exposed folded loops form eyestays for a lace, with each eyestay being formed by a trailing edge of one exposed loop and a leading edge of an adjacent exposed loop. The trailing edge and the leading edge are formed by folded regions in the continuous strip of material that are points of contact for the lace. A second group of secured folded loops are disposed below the exposed loops and are used to attach the lacing element to an upper of the article of footwear.

20 Claims, 10 Drawing Sheets

FOLDED LOOP FASTENING SYSTEM FOR AN ARTICLE OF FOOTWEAR

BACKGROUND

The present invention relates generally to an article of footwear, and in particular to a fastening system for an article of footwear configured with lacing elements formed by folded loops.

Articles of footwear generally include some kind of provision that allows the article to be opened to allow entry of a wearer's foot, and to be closed so that the article is secured to the wearer's foot. In the past, fastening systems have been used. In particular, fastening systems incorporating a lace threaded through eyelets in the upper have been proposed. However, laces are sometimes difficult for a wearer to use. In particular, laces could be challenging to tighten sufficiently on a foot, as the force needed to pull the laces through eyelets on the upper can prove difficult for a wearer.

Therefore, there exists a need in the art for a fastening system for an article of footwear that can assist a wearer with tightening laces.

SUMMARY

In one aspect, the invention provides an article of footwear comprising: an upper including a fastening portion; a lacing element associated with the fastening portion; and wherein the lacing element is made from a continuous strip of material that has been folded to form a plurality of folded loops; and wherein a trailing edge of a first folded loop and a leading edge of a second folded loop adjacent to the first folded loop form an eyestay configured to receive a lace.

In another aspect the invention provides an article of footwear comprising: an upper including a fastening portion; a lacing element associated with the fastening portion; and wherein the lacing element is made from a continuous strip of material that has been folded to form a plurality of folded loops; wherein an engaging portion of the lacing element is disposed above the upper; wherein a securing portion of the lacing element is attached to the upper; and wherein the engaging portion and the securing portion comprise a substantially similar amount of the continuous strip of material.

In another aspect the invention provides an article of footwear comprising: an upper; a lacing element comprising a continuous strip of material that has been folded to form a plurality of folded loops, the lacing element being configured to attach to the upper; the lacing element including a first folded loop, the first folded loop comprising a first folded region and a second folded region of the strip of material separated by a first run gap associated with a first distance; the lacing element including a second folded loop, the second folded loop comprising a third folded region and a fourth folded region of the strip of material separated by a second run gap associated with a second distance; and wherein the second distance is larger than the first distance.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
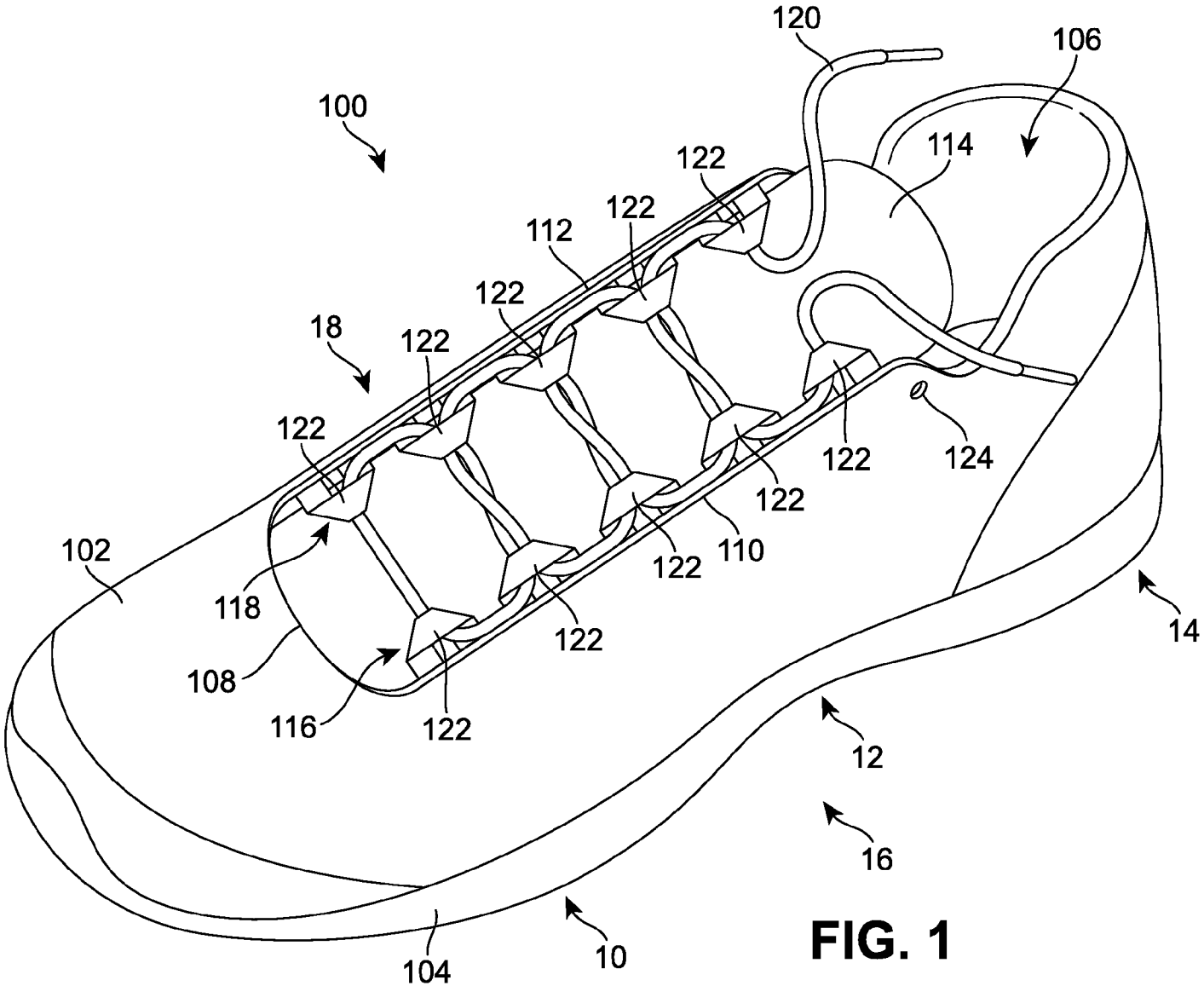
FIG. 1 is an isometric view of an exemplary embodiment of an article of footwear.
Figure 2:
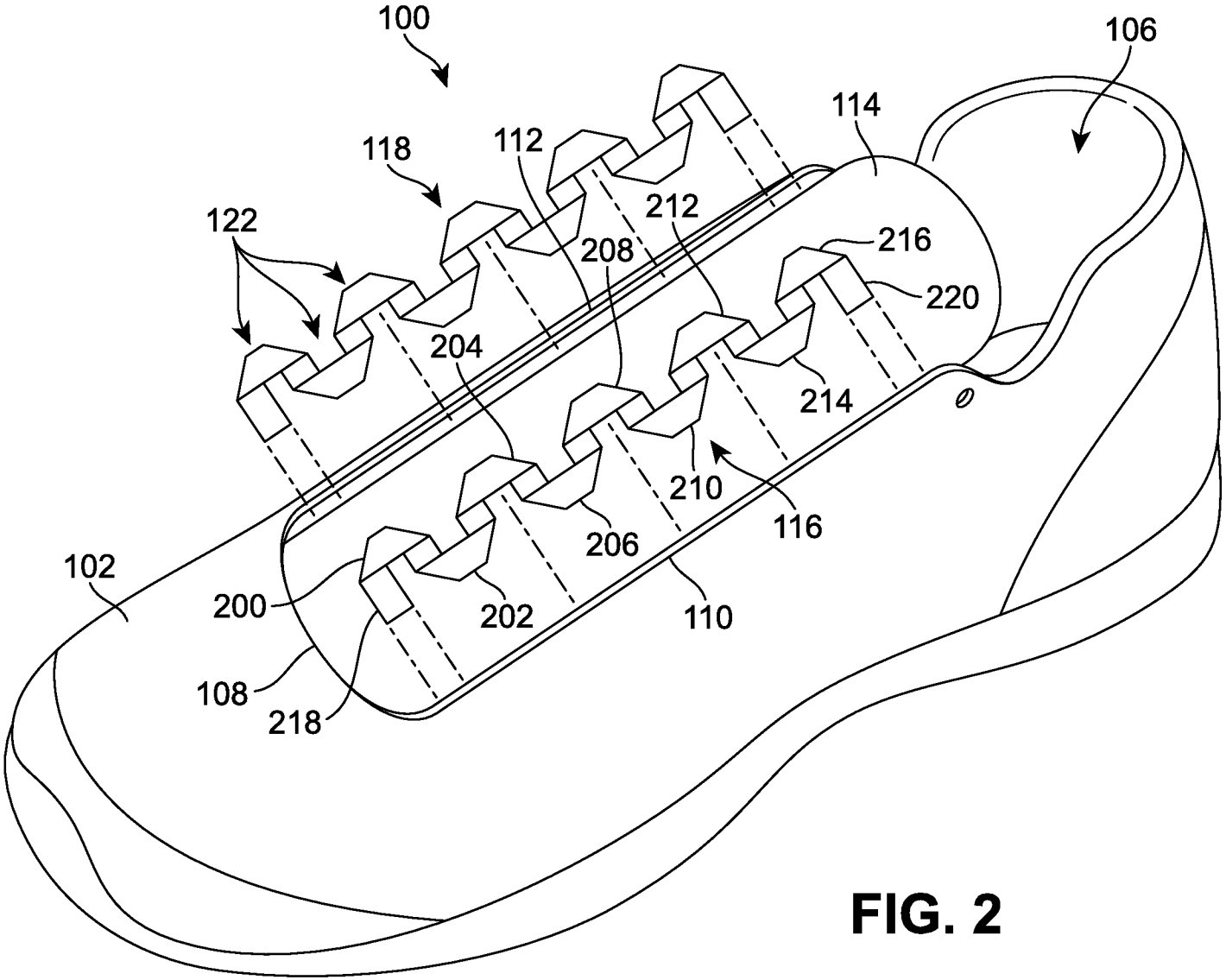
FIG. 2 is an exploded isometric view of an exemplary embodiment of an article of footwear with lacing elements.

FIGS. 1 and 2 illustrate views of an embodiment of an article of footwear 100. In particular, FIG. 1 is an isometric view and FIG. 2 is an exploded isometric view of an exemplary embodiment of an article of footwear 100. For clarity, the following detailed description discusses an exemplary embodiment, in the form of a sneaker, but it should be noted that the present embodiments could take the form of any article of footwear including, but not limited to: hiking boots, soccer shoes, football shoes, sneakers, rugby shoes, basketball shoes, baseball shoes as well as other kinds of shoes. Articles of footwear may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures. As shown in FIGS. 1 and 2, article of footwear 100, also referred to simply as article 100, is intended to be used with a left foot; however, it should be understood that the following description may equally apply to a mirror image of article of footwear 100 that is intended for use with a right foot.

Referring to FIGS. 1 and 2, for purposes of reference, article 100 may be divided into forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot region 10, midfoot region 12 and heel region 14.

It will be understood that forefoot region 10, midfoot region 12 and heel region 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot region 10, midfoot region 12 and heel region 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot region to a heel region of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Article 100 may include an upper 102 and a sole structure 104. Generally, upper 102 may be any type of upper. In particular, upper 102 may have any design, shape, size and/or color. For example, in embodiments where article 100 is a running shoe or sneaker, upper 102 could be a low top upper. In embodiments where article 100 is a basketball shoe, upper 102 could be a high top upper that is shaped to provide high support on an ankle.

Referring to FIG. 1, upper 102 includes an entry hole 106 disposed near heel region 14 for receiving a foot of a wearer. In some embodiments, entry hole 106 may be configured to allow a foot to be inserted within an interior of article 100. In an exemplary embodiment, article of footwear 100 may include a fastening system configured to tighten upper 102 around a foot of a wearer. Generally, article of footwear 100 may be associated with any type of fastening system including, but not limited to laces, straps, zippers, hook and loop fasteners, as well as other types of fastening systems. In an exemplary embodiment, article of footwear 100 includes a fastening system configured to be used with a lace.

In this embodiment, article of footwear 100 includes a lace 120 to secure a foot within upper 102. In some embodiments, lace 120 may be configured with any length necessary to fasten upper 102. In addition, lace 120 may be configured with a particular cross-sectional shape. In some embodiments, lace 120 may have a substantially flat cross section. In other embodiments, lace 120 may have a substantially rounded cross section.

Generally, lace 120 may comprise any material including, but not limited to leather, cotton, jute, hemp, or synthetic fibers. Additionally, lace 120 may be coated with a material to increase friction in order to keep lace 120 fastened. In some cases, lace 120 may include elastic portions. Also, referring to FIG. 1, in some cases, a first end and a second end of lace 120 may be configured with aglets to assist with threading lace 120.

In order to fasten upper 102, lace 120 may be configured to span a lacing gap 108. In different embodiments, lacing gap 108 may be disposed in various locations on upper 102. In some embodiments, lacing gap 108 may be disposed between a medial side portion and a lateral side portion of upper 102. In other embodiments, lacing gap 108 may be disposed asymmetrically so that a portion of lacing gap 108 is disposed closer to, or entirely within, the medial side portion or the lateral side portion of upper 102.

In an exemplary embodiment, lacing gap 108 may be disposed between a lateral fastening portion 110 associated with the lateral side portion of upper 102 and a medial fastening portion 112 associated with the medial side portion of upper 102. In some embodiments, lateral fastening portion 110 and/or medial fastening portion 112 may include one or more provisions for associating with a fastening system. In an exemplary embodiment, one or more lacing elements may be associated with lateral fastening portion 110 and/or medial fastening portion 112. Lacing elements may be configured to attach to upper 102 along lateral fastening portion 110 and/or medial fastening portion 112 and engage with a lace, including lace 120.

In some embodiments, article 100 may be provided with a fastening system that includes one or more lacing elements associated with each of lateral side 16 and/or medial side 18 of upper 102. In an exemplary embodiment, a lateral lacing element 116 may be disposed along lateral fastening portion 110 of upper 102 and a medial lacing element 118 may be disposed along medial fastening portion 112 of upper 102. In one embodiment, lateral lacing element 116 and/or medial lacing element 118 may be disposed along an edge of upper 102 at lateral fastening portion 110 and/or medial fastening portion 112.

In some embodiments, lateral lacing element 116 and/or medial lacing element 118 may be provided with a plurality of folded loops 122. In an exemplary embodiment, plurality of folded loops 122 may be configured to engage with lace 120. In an exemplary embodiment, plurality of folded loops 122 disposed on lateral lacing element 116 and/or medial lacing element 118 may be configured to tighten upper 102 using lace 120. With this arrangement, when lace 120 is pulled, lateral fastening portion 110 and medial fastening portion 112 may be brought closer to each other across lacing gap 108, thereby tightening upper 102.

In some embodiments, portions of upper 102 other than lateral fastening portion 110 and/or medial fastening portion 112 may include provisions to receive lace 120. In one embodiment, a portion of upper 102 towards entry hole 106 may include an eyelet 124. The term "eyelet" as used throughout this detailed description and in the claims refers to a structure configured to receive a lace in an article of footwear. For example, in some embodiments, an eyelet may be a small hole or perforation. In some cases, an eyelet may be a hole that is reinforced with a material, including but not limited to metal, cord, fabric or leather. In other embodiments, an eyelet may be an opening formed by a loop of material including but not limited to, fabric, cord, leather or metal. In addition, eyelet 124 may be disposed in a similar location on both lateral side 16 and/or medial side 18 of upper 102. With this arrangement, eyelet 124 may secure lace 120 near entry hole 106. In some embodiments, eyelet 124 is optional and may be omitted.

In some embodiments, upper 102 may further include one or more separate provisions configured to be associated with upper 102. In some embodiments, upper 102 may include a tongue 114. In an exemplary embodiment, a portion of tongue 114 may be associated with upper 102 adjacent to lacing gap 108 near forefoot region 10 of article 100. In one embodiment, a portion of tongue 114 may be fixedly attached to upper 102 and be disposed within lacing gap 108. In other cases, tongue 114 may be removably attached to upper 102. Generally, tongue 114 may have any design, shape, size and/or color. In some cases, tongue 114 may provide a particular aesthetic appearance for article 100. In addition, tongue 114 may include padding or other provisions to increase comfort for a foot when lace 120 fastens upper 102 around a foot. In addition, tongue 114 may also include provisions to receive lace 120.

For purposes of clarity, only some portions of upper 102 are discussed in the various embodiments described herein. It should be understood that upper 102 may include other provisions that are known in the art for assisting in walking, running or other athletic maneuvers. In addition, upper 102 may preferably be associated with a sole structure 104 of article of footwear 100. Sole structure 104 may be any kind of sole structure. In some embodiments, sole structure 104 may include one or more of an outsole, a midsole, and/or an insole. In some cases, one or more of these components may be optional. In various embodiments, sole structure 104 may include any known components associated with a sole structure for an article of footwear.

Referring now to FIG. 2, an exploded view of article of footwear 100 with lacing elements. In this embodiment, article 100 includes lateral lacing element 116 and medial lacing element 118. In some embodiments, each lacing element may include plurality of folded loops 122. In an exemplary embodiment, each lacing element, including lateral lacing element 116 and/or medial lacing element 118, may be formed from a continuous strip of material. In different embodiments, a lacing element may be made of various materials. Examples of various materials that could be used include, but are not limited to, one or more of the following materials: natural leather, synthetic leather, textiles, polymer sheets or strips, as well as other types of natural or synthetic materials. In one embodiment, lacing elements may be made of a generally inelastic material that resists stretching. In some cases, the material may be a woven or knitted textile material. In other cases, the material may be a plastic or polymer material. In other embodiments, lacing elements may be made of an elastic material that is configured to stretch in one or more directions.

In some embodiments, a lacing element may be made from a continuous strip of material by selectively folding one or more portions of the material in different directions so as to form folded loops, described in more detail below. As shown in FIG. 2, lateral lacing element 116 and/or medial lacing element 118 may each be made of a continuous strip of material to form plurality of folded loops 122. In some embodiments, a first portion of the plurality of folded loops 122 may be exposed above upper 102 as exposed loops. The exposed loops may be configured to engage with a lace, as described above. In addition, a second portion of the plurality of folded loops 122 may be disposed within upper 102 as secured loops. The secured loops may be configured to secure lateral lacing element 116 and/or medial lacing element 118 to upper 102.

In an exemplary embodiment, lateral lacing element 116 may include a first portion of the plurality of folded loops 122 that are configured to be exposed above upper 102 as exposed loops. In this embodiment, the exposed loops include a first exposed loop 200, a second exposed loop 204, a third exposed loop 208, a fourth exposed loop 212, and a fifth exposed loop 216. In this embodiment, first exposed loop 200 may be disposed on lateral lacing element 116 adjacent to the front of lacing gap 108 near forefoot region 10. In addition, second exposed loop 204, third exposed loop 208, fourth exposed loop 212, and fifth exposed loop 216 may be disposed along lateral lacing element 116 extending in a rearward direction towards heel region 14, with fifth exposed loop 216 disposed adjacent to the rear of lacing gap near entry hole 106.

In some embodiments, lateral lacing element 116 may also include a second portion of the plurality of folded loops 122 that are configured to secure lateral lacing element 116 to upper 102 at lateral fastening portion 110 as secured loops. In this embodiment, the secured loops include a first secured loop 202, a second secured loop 206, a third secured loop 210, and a fourth secured loop 214. In this embodiment, first secured loop 202 may be disposed on lateral lacing element 116 near the front of lacing gap 108. In one embodiment, first secured loop 202 may be disposed below a portion of first exposed loop 200 and second exposed loop 204. Second secured loop 206, third secured loop 210, and fourth secured loop 214 may be disposed along lateral lacing element 116 extending in a rearward direction towards heel region 14, with fourth secured loop 214 disposed near the rear of lacing gap near entry hole 106.

In some embodiments, lateral lacing element 116 may also include one or more additional provisions to secure lateral lacing element 116 to upper 102. In one embodiment, one or more anchor elements may be disposed at the front and/or rear of lateral lacing element 116. In this embodiment, lateral lacing element 116 includes a first anchor element 218 disposed at the front of lateral lacing element 116 below first exposed loop 200. Similarly, lateral lacing element 116 also includes a second anchor element 220 disposed at the rear of lateral lacing element 116 below fifth exposed loop 216. With this arrangement, first anchor element 218 and/or second anchor element 220 may be configured to assist with securing lateral lacing element 116 to upper 102 along lateral fastening portion 110. In other embodiments, anchor elements are optional and may be omitted.

In this embodiment, lateral lacing element 116 includes five exposed loops and four secured loops. In other embodiments, however, lateral lacing element 116 may include more or fewer exposed loops and/or secured loops. In addition, it should be understood that medial lacing element 118 may be substantially similar to lateral lacing element 116.

Figure 3:
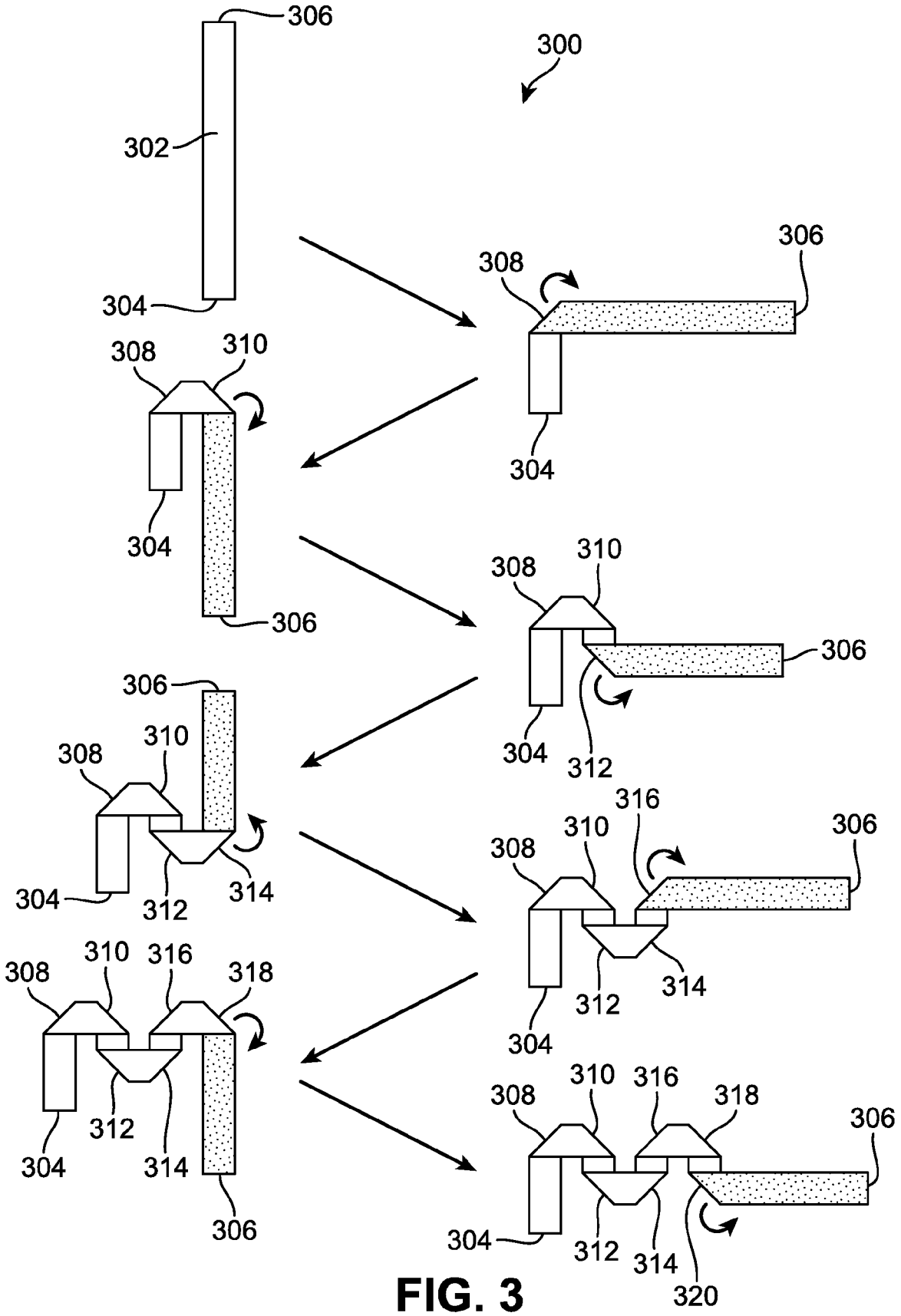
FIG. 3 is a representational view of an exemplary process for forming a lacing element.

Referring now to FIG. 3, an exemplary embodiment of a process 300 for forming a lacing element is illustrated. In particular, it should be understood that process 300 is merely exemplary and other methods of forming a lacing element from a continuous strip of material may be used. Process 300 for forming a lacing element, for example, lateral lacing element 116 and/or medial lacing element 118, may begin with a strip of material 302. Strip of material 302 may be described with reference to a bottom end 304 and a top end 306. It should be understood, however, that these terms are relative and used herein to describe process 300.

Starting with strip of material 302, top end 306 is folded across strip of material 302 to form a first fold 308. It should be understood that by folding strip of material 302 across itself in an approximately perpendicular manner, the folds described herein, including first fold 308, should be approximately 45 degrees. Next, top end 306 is folded under strip of material 302 towards bottom end 304 to form a second fold 310. After forming second fold 310, strip of material 302 includes a first folded loop with an approximately triangular or trapezoidal shape defined by first fold 308 and second fold 310. The first folded loop has a longer side that is disposed facing bottom end 304 and a shorter side that is disposed facing in an opposite direction to form the triangular or trapezoidal shape.

Next, top end 306 is again folded across strip of material 302 to form a third fold 312. Top end 306 is folded under strip of material 302 in a direction opposite bottom end 304 to form a fourth fold 314. After forming fourth fold 314, strip of material 302 includes a second folded loop with an approximately triangular or trapezoidal shape defined by third fold 312 and fourth fold 314. The second folded loop is disposed below a center line of the lacing element such that the second folded loop may be a mirror image of the first folded loop. In this embodiment, the second folded loop has a shorter side that is disposed facing bottom end 304 and a longer side that is disposed facing in an opposite direction towards the first folded loop to form the triangular or trapezoidal shape. In some embodiments, this second folded loop may be a substantially similar shape as the folded loop formed in the previous steps. In other embodiments, the second folded loop may be a different shape as the previous folded loop.

Returning back to process 300, after forming the fourth fold 314, top end 306 may be folded across strip of material 302 to form a fifth fold 316. Next, top end 306 may be folded under strip of material 302 towards bottom end 304 to form a sixth fold 318. After forming sixth fold 318, strip of material 302 includes a third folded loop with an approximately triangular or trapezoidal shape defined by fifth fold 316 and sixth fold 318. The third folded loop has a longer side and a shorter side that face the same direction as the first folded loop, described above. In some embodiments, this third folded loop may be a substantially similar shape as either of the folded loops formed in the previous steps. In other embodiments, the third folded loop may be a different shape than the previous folded loops.

After forming the third folded loop, top end 306 may be folded across strip of material 302 to form a seventh fold 320. At this point, process 300 has been described for forming multiple folded loops for a lacing element, including a first folded loop, a second folded loop, and a third folded loop. A lacing element containing as many folded loops as is desired may be formed by repeating the above steps of process 300 to form additional folded loops in a substantially similar manner. It should be understood that lacing elements, including lateral lacing element 116 and/or medial lacing element 118, may be formed with any number of folded loops using process 300.

Figure 4:
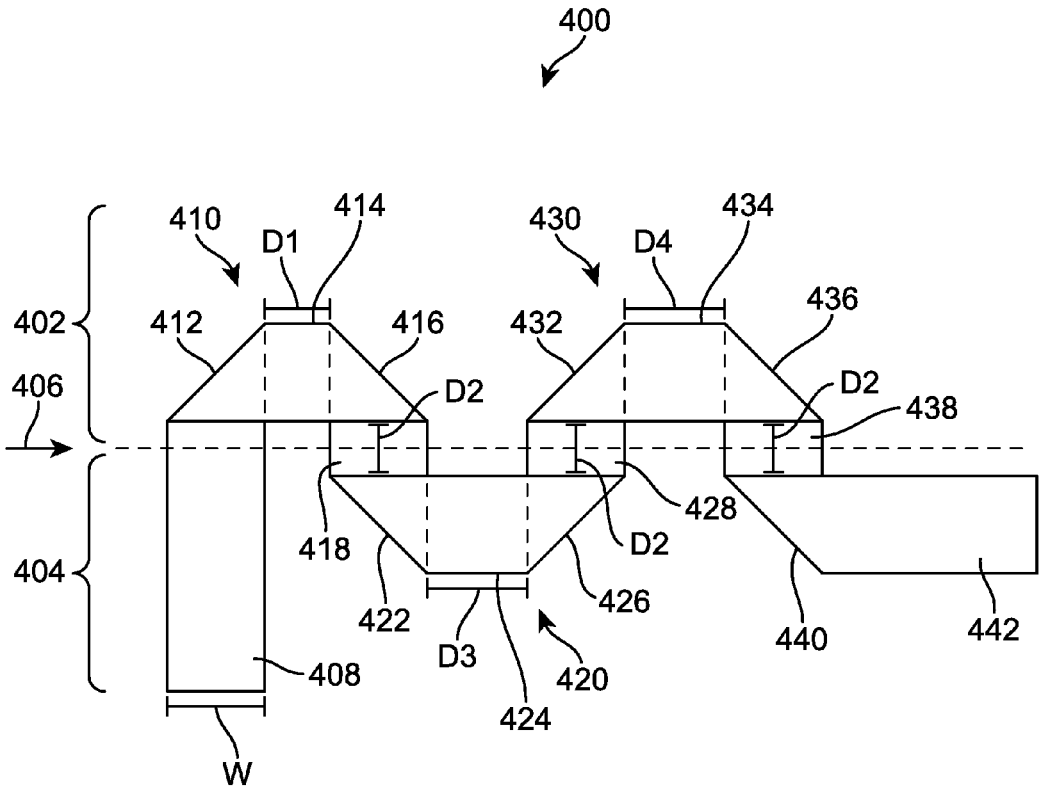
FIG. 4 is a schematic view of an exemplary embodiment of a lacing element.

Referring now to FIG. 4, a schematic view of an exemplary embodiment of a lacing element 400 is illustrated. In some embodiments, lacing element 400 may be formed using process 300, as described above. In this embodiment, lacing element 400 may be formed from a continuous strip of material. Any material described above may be used. In an exemplary embodiment, the material used for lacing element 400 may have a width that is substantially smaller than the length of the material. In addition, the material used for lacing element 400 may be substantially flat such that the thickness of the material is substantially smaller than either the width and/or length of the material.

In an exemplary embodiment, lacing element 400 may be associated with different portions that are configured to be associated with an article, including article 100. In this embodiment, lacing element 400 includes an engaging portion 402. In some embodiments, engaging portion 402 may be a portion of lacing element 400 that is configured to associate or engage with a fastening system. In an exemplary embodiment, engaging portion 402 of lacing element 400 may be configured to engage with a lace for tightening an upper of an article.

In this embodiment, lacing element 400 also includes a securing portion 404. In some embodiments, securing portion 404 may be a portion of lacing element 400 that is configured to associate a lacing element with a portion of an upper of an article. In an exemplary embodiment, securing portion 404 of lacing element 400 may be configured to allow lacing element 400 to be secured or attached to an upper of an article. In this embodiment, a boundary 406 approximately divides engaging portion 402 and securing portion 404 of lacing element 400. In some embodiments, boundary 406 may be coincident with an edge of an upper of an article 100. In an exemplary embodiment, boundary 406 may define the portion of lacing element 400 that extends out of upper 102. In some embodiments, portions of a lacing element may be substantially similar above and below boundary 406. In an exemplary embodiment, one or more portions of lacing element 400 may be substantially similar above and below boundary 406. In one embodiment, the amount of material associated with the continuous strip of material that is disposed in each of engaging portion 402 and securing portion 404 may be substantially similar above and below boundary 406. In another embodiment, shapes of folded loops associated with each of engaging portion 402 and securing portion 404 may be substantially similar above and below boundary 406. In an exemplary embodiment, shapes of folded loops above and below boundary 406 may be mirror images. In other embodiments, shapes of folded loops above and below boundary 406 may be different.

Referring again to FIG. 4, the continuous strip of material that is used to form lacing element 400 is associated with a width W. Width W may be configured to be substantially smaller than an overall length of the strip of material. In an exemplary embodiment, width W may be from 6 mm to 14 mm. In other embodiments, width W may be less than 6 mm. In still other embodiments, width W may be greater than 14 mm. In various embodiments, width W of the strip of material may be selected based on the type of fastening system.

In some embodiments, lacing element 400 may include an anchor element 408. In this embodiment, anchor element 408 is disposed at the beginning of the continuous strip of material forming lacing element 400. In an exemplary embodiment, anchor element 408 may be located within securing portion 404 and may be configured to assist with securing lacing element 400 to upper 102.

In an exemplary embodiment, lacing element 400 may include a first exposed loop 410. In this embodiment, first exposed loop 410 is located within engaging portion 402 and is disposed above anchor element 408 and boundary 406. In an exemplary embodiment, first exposed loop 410 may be configured to engage with a lace associated with a fastening system. In some embodiments, first exposed loop 410 may have a generally triangular or trapezoidal shape. In one embodiment, first exposed loop 410 may be associated with a first folded region 412 disposed along a front or leading edge of lacing element 400. First exposed loop 410 may also be associated with a run gap 414. Run gap 414 may be a portion of first exposed loop 410 that extends along a first distance D1 before the strip of material is folded again at a second folded region 416. In this embodiment, second folded region 416 is disposed along a rear or trailing edge of lacing element 400. With this arrangement, first distance D1 associated with run gap 414 may be configured to define the shape of first exposed loop 410. In cases where first exposed loop 410 has a generally triangular shape, first distance D1 of run gap 414 will be small. In cases where first exposed loop 410 has a generally trapezoidal shape, first distance D1 will be larger. In some embodiments, first distance D1 associated with run gap 414 may be selected to accommodate one or more portions of a lace or other component of a fastening system.

In this embodiment, first exposed loop 410 is disposed at a distal end of lacing element 400 disposed near a forefoot region of an article. In an exemplary embodiment, first exposed loop 410 may be configured to engage with a single portion of a lace. Accordingly, run gap 414 may be associated with first distance D1 that may be selected so as to provide sufficient accommodation for a single portion of a lace. In contrast, additional exposed loops located adjacent to first exposed loop 410 and closer to the proximal end of lacing element 400 may have run gaps that are associated with distances greater than first distance D1 so as to accommodate at least two portions of a lace.

In some embodiments, lacing element 400 may include a span 418 between first exposed loop 410 and a first secured loop 420. Span 418 may be a portion of the continuous strip of material that extends from first exposed loop 410 across boundary 406 to first secured loop 420 disposed within securing portion 404 of lacing element 400. In an exemplary embodiment, span 418 may be associated with a second distance D2. In various embodiments, second distance D2 of span 418 may be selected to provide for a separation between exposed loops in engaging portion 402 and secured loops in securing portion 404. With this arrangement, a larger or smaller second distance D2 associated with span 418 allows the separation of exposed loops and secured loops to be increased or decreased.

In some embodiments, first secured loop 420 may be disposed within securing portion 404 and be located below first exposed loop 410 and boundary 406. In an exemplary embodiment, first secured loop 420 may be configured to secure lacing element 400 to a portion of an upper. In some embodiments, first secured loop 420 may have a generally triangular or trapezoidal shape. In one embodiment, first secured loop 420 may be associated with a third folded region 418 disposed along the front edge of lacing element 400. First secured loop 420 may also be associated with a run gap 424. Run gap 424 may be a portion of first secured loop 420 that extends along a third distance D3 before the strip of material is folded again at a fourth folded region 426. In this embodiment, fourth folded region 426 is disposed along the rear edge of lacing element 400. With this arrangement, third distance D3 associated with run gap 424 may be configured to define the shape of first secured loop 420, as described above in regard to run gap 414 of first exposed loop 410. In addition, in some embodiments, third distance D3 associated with run gap 424 may be configured to define the separation distance between adjacent exposed loops disposed in engaging region 402.

In an exemplary embodiment, third distance D3 associated with run gap 424 of first secured loop 420 may be larger than first distance D1 associated with run gap 414 of first exposed loop 410. In other embodiments, third distance D3 may be smaller than first distance D1. In still other embodiments, third distance D3 and first distance D1 may be substantially similar.

In some embodiments, lacing element 400 may include a span 428. Span 428 may be a portion of the continuous strip of material that extends from first secured loop 420 across boundary 406 to a second exposed loop 430 disposed within engaging portion 402 of lacing element 400. In this embodiment, span 428 is substantially similar to span 418 and is associated with second distance D2. In other embodiments, span 428 may be associated with a different distance that is larger than second distance D2 or smaller than second distance D2.

In this embodiment, lacing element 400 includes second exposed loop 430 located within engaging portion 402 and disposed above boundary 406 and first secured loop 420. In an exemplary embodiment, second exposed loop 430 may be configured to engage with a lace associated with a fastening system. In some embodiments, second exposed loop 430 may have a generally triangular or trapezoidal shape, as described above in reference to first exposed loop 410. In one embodiment, second exposed loop 430 may be associated with a fifth folded region 432 disposed along the front edge of lacing element 400. Second exposed loop 430 may also be associated with a run gap 434. Run gap 434 may be a portion of second exposed loop 430 that extends along a fourth distance D4 before the strip of material is folded again at a sixth folded region 436. In this embodiment, sixth folded region 436 is disposed along the rear edge of lacing element 400. With this arrangement, fourth distance D4 associated with run gap 434 may be configured to define the shape of second exposed loop 430.

In this embodiment, second exposed loop 430 is disposed adjacent to first exposed loop 410 in a direction towards a proximal end of lacing element 400. In an exemplary embodiment, second exposed loop 430 may be configured to engage with at least two portions of a lace. Accordingly, run gap 434 may be associated with fourth distance D4 that may be selected so as to provide sufficient accommodation for at least two portions of a lace. In an exemplary embodiment, fourth distance D4 associated with run gap 434 of second exposed loop 430 may be larger than first distance D1 associated with run gap 414 of first exposed loop 410. In an exemplary embodiment, fourth distance D4 may be substantially similar to third distance D3, described above. In other embodiments, fourth distance D4 may be larger than third distance D3. In addition, in still other embodiments, fourth distance D4 and first distance D1 may be substantially similar.

In some embodiments, lacing element 400 may include a span 438. Span 438 may be a portion of the continuous strip of material that extends from second exposed loop 430 across boundary 406 into securing portion 404 of lacing element 400. In this embodiment, span 438 is substantially similar to span 418 and/or span 428 and is associated with second distance D2. In other embodiments, span 438 may be associated with a different distance that is larger than second distance D2 or smaller than second distance D2.

In this embodiment, the continuous strip of material within securing portion 404 may include a seventh folded region 440. In some embodiments, seventh folded region 440 may be associated with another secured loop, in a substantially similar manner as first secured loop 420, described above. While the continuous strip of material is shown ending at end 442 in FIG. 4, it should be understood that a lacing element including any number of exposed loops and secured loops may be formed using the principles described herein and illustrated in FIGS. 3 and 4. In some embodiments, each successive exposed loop and/or secured loop may share a similar structure as any of first exposed loop 410, second exposed loop 430, and/or first secured loop 420. In other embodiments, one or more of the characteristics of each exposed loop and/or secured loop may be varied, including the distances associated with a run gap and/or a span between an exposed loop and a secured loop to vary the arrangement of the folded loops disposed on the lacing element.

Figure 5:
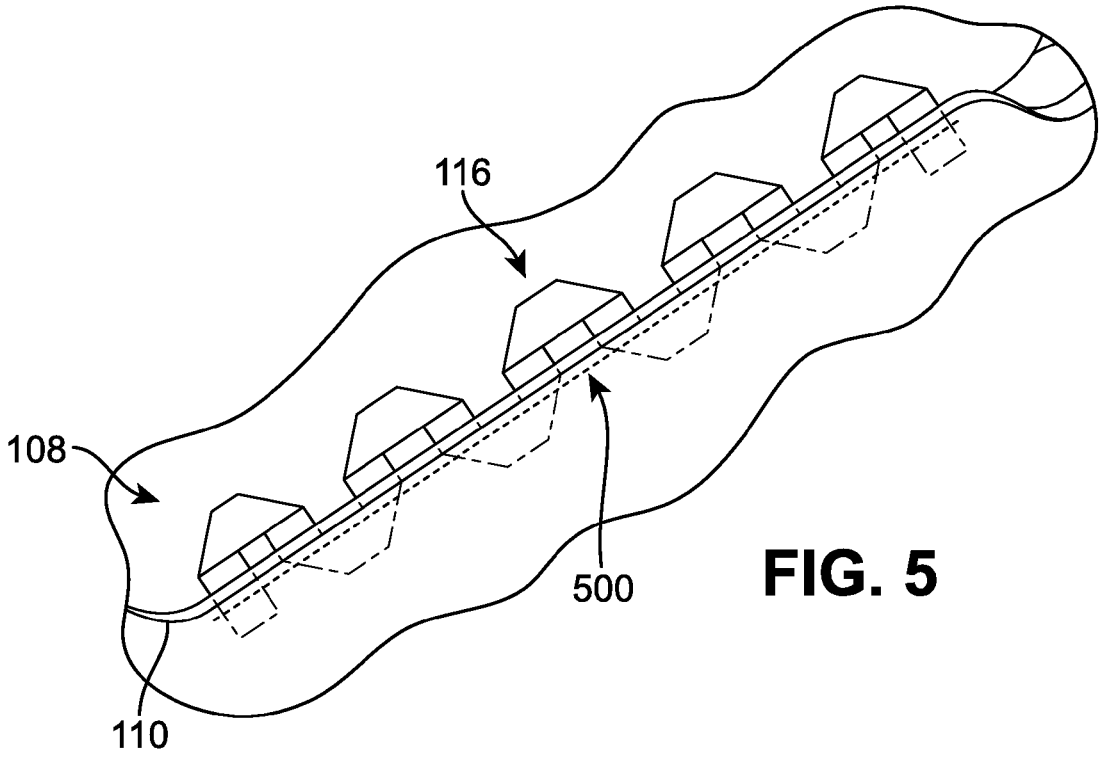
FIG. 5 is an enlarged view of an exemplary embodiment of a lacing element attached to an upper of an article of footwear.
Figure 6:
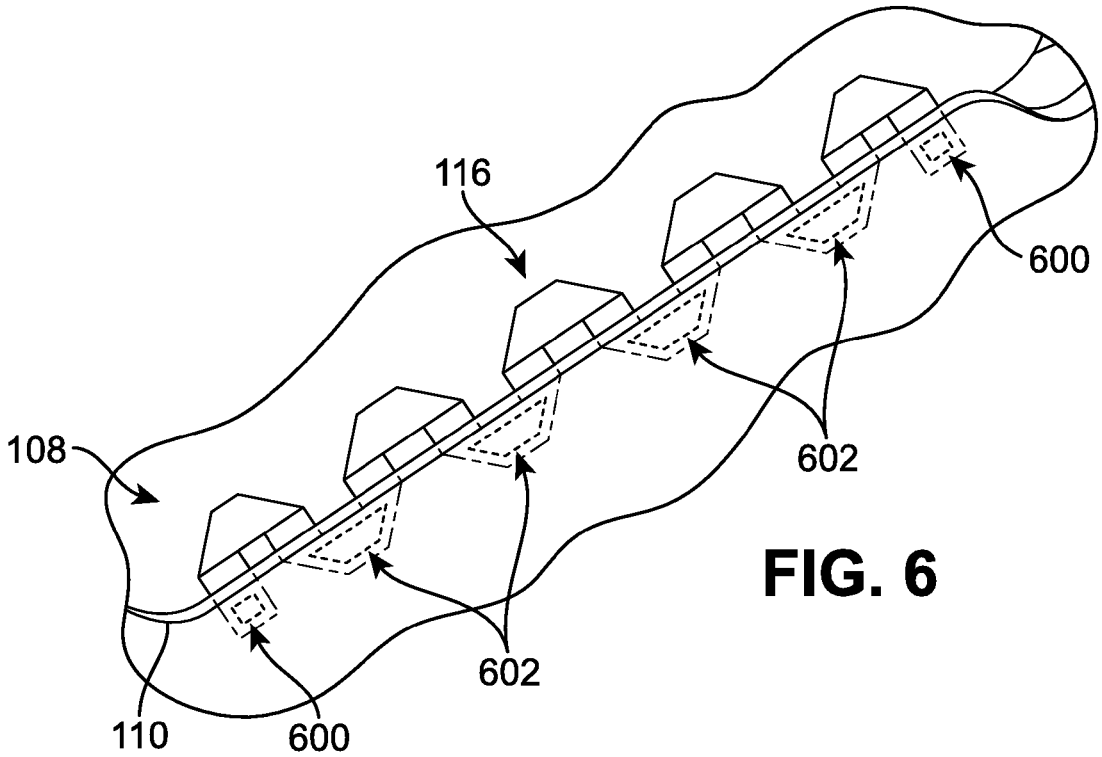
FIG. 6 is an enlarged view of an alternate embodiment of a lacing element attached to an upper of an article of footwear.

In some embodiments, a portion of a lacing element may be configured to secure the lacing element to a portion of an upper of an article. FIGS. 5 and 6 illustrate different embodiments of attachment mechanisms for securing a lacing element to an upper of an article. While FIGS. 5 and 6 illustrate embodiments of securing lateral lacing element 116 to an upper, it should be understood that a similar arrangement may be provided to secure one or more additional lacing elements to an upper, including medial lacing element 118. In some embodiments, a lacing element may be temporarily mounted on a carrier or jig element configured to hold the lacing element in place while the lacing element is attached to the upper. In an exemplary embodiment, an adhesive tape may be used to keep the lacing element in place while the lacing element is attached to the upper as shown in FIGS. 5 and 6. In other embodiments, other mechanisms to hold the lacing element in place while being attached may be used.

Referring now to FIG. 5, in this embodiment, lateral lacing element 116 is shown secured to upper 102 along lateral fastening portion 110. In an exemplary embodiment, lateral lacing element 116 may be secured to upper 102 using stitching 500.

Generally, stitching 500 may be any kind of stitching that may be used to accomplish the attachment of lateral lacing element 116 to upper 102. In some cases, simple stitches may be used. In other cases, more complex stitches may be used. Examples of various stitches that may be used include, but are not limited to: backstitches, basting stitches, blind stitches, buttonhole stitches, chain stitches, cross-stitches, embroidery stitches, feather stitches, hemming stitches, lock stitches, padding stitches, running stitches, serge stitches, slip stitches, stretch stitches, top stitches, whip stitches, zigzag stitches as well as any other types of machine or manual stitches. In this embodiment, stitching 500 is a straight stitch.

In an exemplary embodiment, stitching 500 may run across the securing portion of lateral lacing element 116, including one or more anchor elements and/or secured loops. In this embodiment, stitching 500 attaches lateral lacing element 116 on an inside of upper 102 along lateral fastening portion 110. With this arrangement, the secured loops and/or anchor elements may be attached to upper 102 within the interior of article 100. In other embodiments, however, stitching 500 may be used to attach lateral lacing element 116 on the outside of upper 102 so that secured loops and/or anchor elements may be attached to upper 102 on the exterior of article 100.

Referring now to FIG. 6, an alternate embodiment of stitching that may be used to attach a lacing element to an upper is illustrated. In this embodiment, stitching may include a plurality of separate stitched areas to attach one or more of the secured loops and/or anchor elements on an inside of upper 102 along lateral fastening portion 110. In this embodiment, the stitching may be a box stitch. In one embodiment, a first box stitch 600 may be used to attach one or more anchor elements to upper 102. In addition, a second box stitch 602 may be used to attach one or more secured loops to upper 102. In this embodiment, each box stitch, including first box stitch 600 and/or second box stitch 602 has an approximately similar shape as the shape of the anchor element and/or secured loop that is being attached to the upper. Accordingly, in this embodiment, first box stitch 600 has an approximately square shape to correspond to the shape of the anchor elements. Similarly, in this embodiment, second box stitch 602 has an approximately trapezoidal shape to correspond to the shape of the secured loop. In other embodiments, however, the shape of the box stitch may have different shapes. In addition, in the embodiment illustrated in FIG. 6, first box stitch 600 and second box stitch 602 are used to attach one or more of the anchor elements and/or secured loops to secure lateral lacing element 116 to upper 102 within the interior of article 100. In other embodiments, however, first box stitch 600 and/or second box stitch 602 may be used to attach lateral lacing element 116 on the outside of upper 102 so that secured loops and/or anchor elements may be attached to upper 102 on the exterior of article 100.

In addition, while the present embodiments describe attaching lacing elements to an upper using different types of stitches, it should be understood that in other embodiments, one more types of additional attachment mechanisms may be used to assist with attaching a lacing element to an upper, including, but not limited to various types of adhesives or other attachment mechanisms. In addition, one or more types of attachment mechanisms may be used together to attach portions of a lacing element to an upper.

Figure 7:
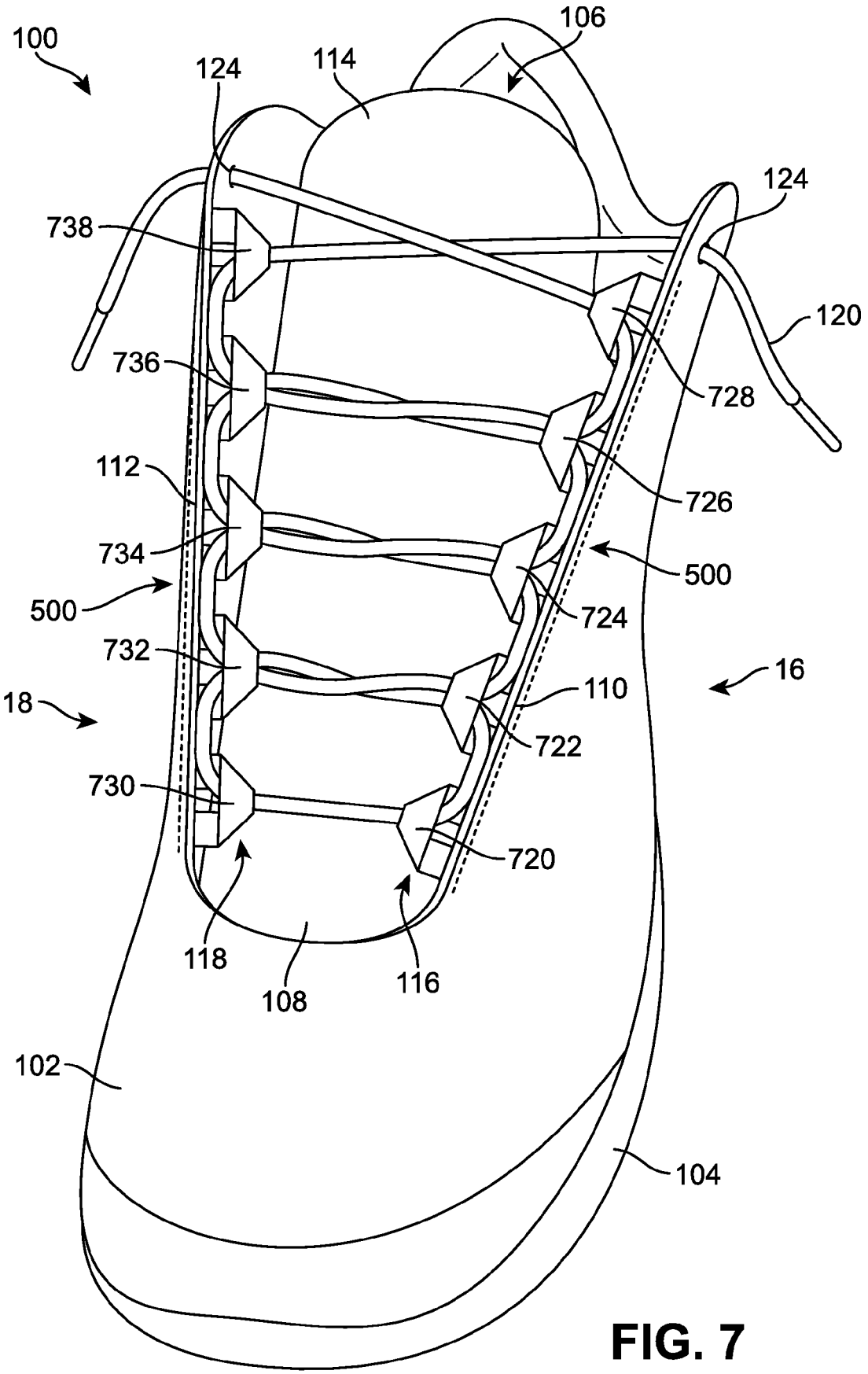
FIG. 7 is an isometric view of an exemplary embodiment of a fastening system for an article of footwear.
Figure 8:
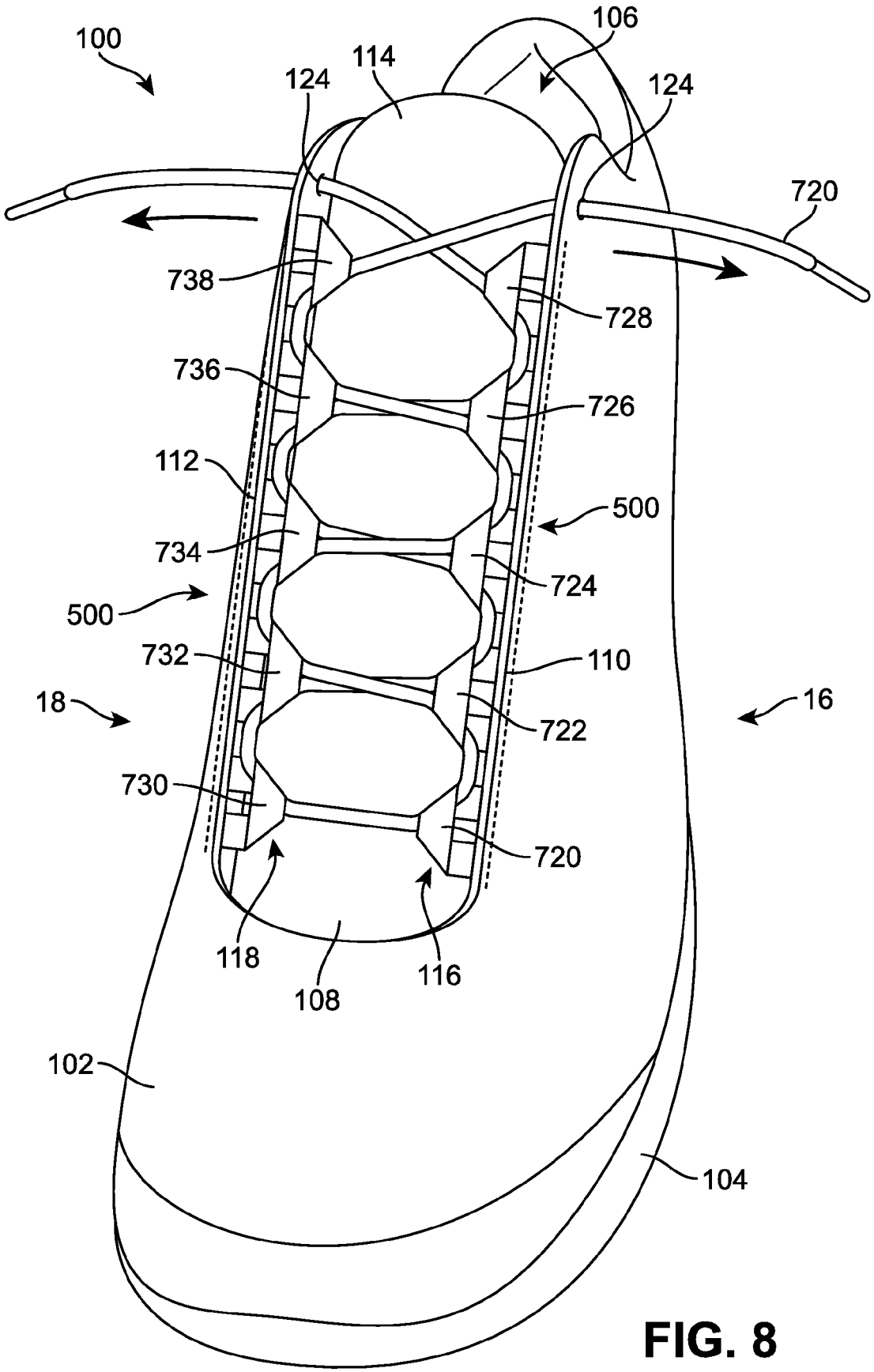
FIG. 8 is an isometric view of an exemplary embodiment of a tightened fastening system for an article of footwear.
Figure 9:
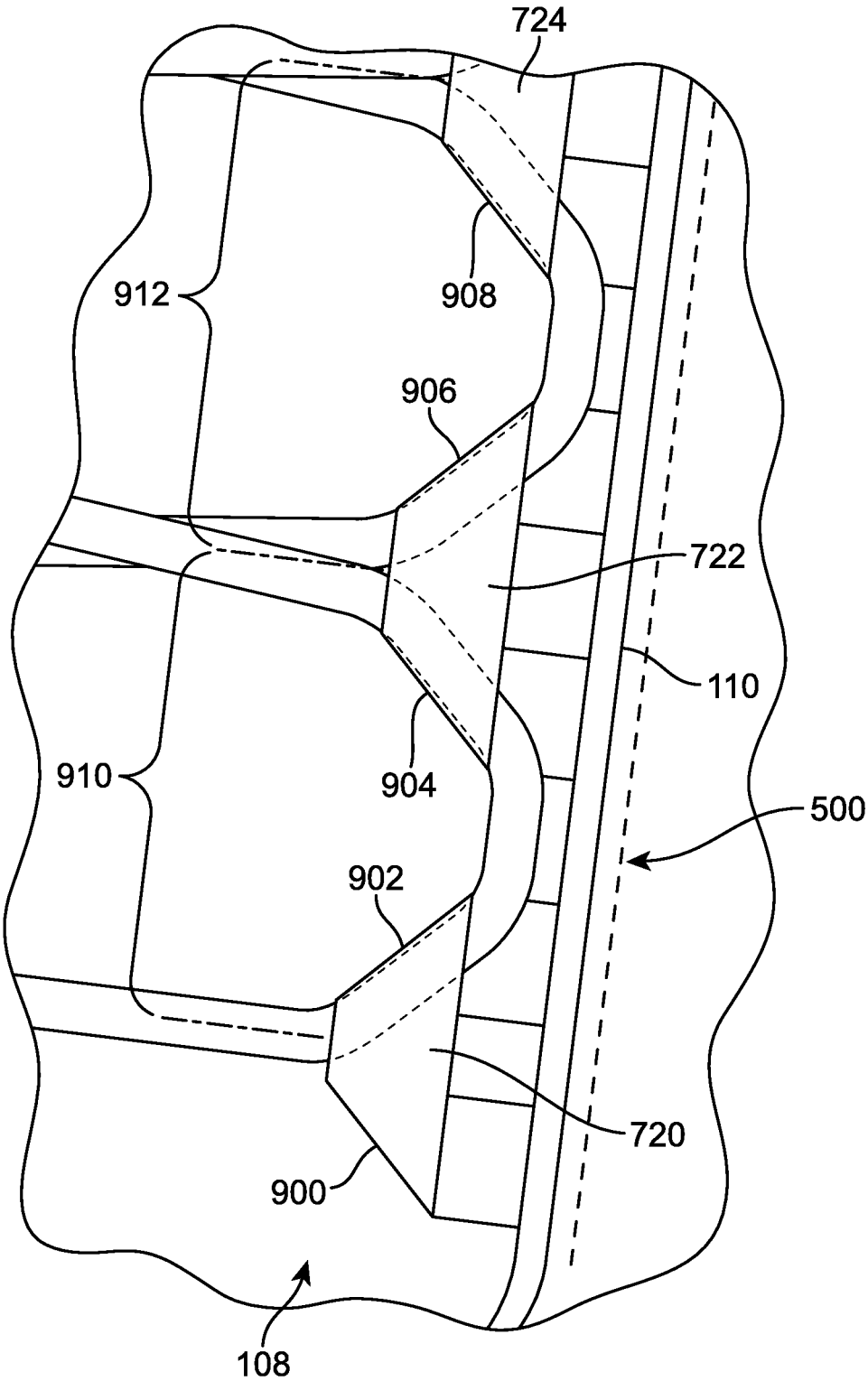
FIG. 9 is an enlarged view of an exemplary embodiment of a lace receiving member disposed on a lacing element associated with a fastening system for an article of footwear.

In some embodiments, a fastening system including one or more lacing elements may be used to tighten an article of footwear around a foot of a wearer. FIGS. 7 through 9 illustrate an exemplary embodiment of an article 100 with a fastening system using lacing elements formed from a continuous strip of material with a plurality of folded loops. Referring to FIG. 7, article 100 includes upper 102 and sole structure 104, as described above. In this embodiment, article 100 includes lateral lacing element 116 disposed on lateral side 16 of lacing gap 108 and medial lacing element 118 disposed on medial side 18 of lacing gap 108. In this embodiment, lateral lacing element 116 and medial lacing element 118 are attached to upper 102 using stitching 500, as described above. In other embodiments, one or more lacing elements may be secured to upper 102 using any of the methods described above.

In some embodiments, lace 120 may be engaged with one or more of the exposed loops disposed within the engaging portion of lateral lacing element 116 and medial lacing element 118. In an exemplary embodiment, lace 120 may be associated with a first exposed loop 720, a second exposed loop 722, a third exposed loop 724, a fourth exposed loop 726, and a fifth exposed loop 728 associated with lateral lacing element 116. Similarly, lace 120 may be associated with a sixth exposed loop 730, a seventh exposed loop 732, an eighth exposed loop 734, a ninth exposed loop 736, and a tenth exposed loop 738 associated with medial lacing element 118.

In some embodiments, one or more portions of lace 120 may be disposed through one or more portions of an exposed loop on a lacing element. In an exemplary embodiment, a portion of lace 120 may be associated with a rear or trailing edge of one exposed loop and a front or leading edge of an adjacent exposed loop. With this arrangement, two adjacent exposed loops on lateral lacing element 116 and/or medial lacing element 118 may serve as an eyestay for lace 120. In this embodiment, lace 120 is disposed through a plurality of eyestays defined by the trailing edge and leading edge of adjacent exposed loops on lateral lacing element 116 and medial lacing element 118 in an alternating manner. In an exemplary embodiment, an eyestay defined by the trailing edge and leading edge of adjacent exposed loops on the lacing element may serve to distribute the pressure from lace 120 between the two adjacent exposed loops. With this arrangement, the pressure may be more evenly distributed across the fastening system.

In some embodiments, lace 120 may also be engaged with one or more additional provisions associated with upper 102 and article 100. In this embodiment, lace 120 is engaged with eyelets 124 disposed on lateral side 16 and medial side 18 of upper 102. In some embodiments, tongue 114 may further include additional provisions for engaging with lace 120 and configured to assist tongue 114 stay within lacing gap 108.

Referring again to FIG. 7, in this embodiment, lace 120 is shown in a substantially loose position. In some embodiments, the configuration of the eyestays defined by the trailing edge and leading edge of adjacent exposed loops may assist a wearer with pulling lace 120 to tighten article 100 around a foot of the wearer.

Referring now to FIG. 8, in this embodiment, lace 120 is shown in a substantially tightened position. In an exemplary embodiment, when a wearer pulls on lace 120 to tighten article 100 around the foot of the wearer, the eyestay configuration defined by the trailing edge and leading edge of adjacent exposed loops may quickly and easily allow lace 120 to move. With this arrangement, the eyestays may act as speed lacing mechanism to allow quick tightening of lace 120 along each of lateral lacing element 116 and medial lacing element 118 by pulling on opposite ends of lace 120 near entry hole 106. In addition, the eyestay configuration defined by the trailing edge and leading edge of adjacent exposed loops on the lacing element may serve to distribute the pressure from lace 120 between the two adjacent exposed loops when lace 120 is tightened. With this arrangement, the pressure may be more evenly distributed across the fastening system.

Referring now to FIG. 9, two eyestay arrangements on lateral lacing element 116 are shown. In this embodiment, lace 120 may be disposed through a trailing edge 902 of first exposed loop 720 and through a leading edge 904 of second exposed loop 722 to define a first eyestay 910. In an exemplary embodiment, trailing edge 902 of first exposed loop 720 and leading edge 904 of second exposed loop 722 are formed by folded regions in the continuous strip of material, as described above in reference to FIG. 4. In this embodiment, the folded regions associated with trailing edge 902 and/or leading edge 904 guide lace 120 at approximately an angle of 45 degrees on either side of first eyestay 910. In other embodiments, the folded regions associated with a leading edge and/or a trailing edge may guide a lace at an angle larger or smaller than 45 degrees. In addition, in this embodiment, first eyestay 910 is configured to distribute the pressure from lace 120 across trailing edge 902 of first exposed loop 720 and leading edge 904 of second exposed loop 722. With this arrangement, first exposed loop 720 and second exposed loop 722 may evenly distribute the pressure from lace 120 when lace 120 is pulled tight.

In this embodiment, first exposed loop 720 is disposed at the distal end of lateral lacing element 116 near forefoot region 10 of article 100. Accordingly, first exposed loop 720 may be configured to accommodate a single portion of lace 120. As shown in FIG. 9, leading edge 900 of first exposed loop 720 does not contact a portion of lace 120. As a result, first exposed loop 720 may be associated with a run gap that is smaller than the run gap associated with second exposed loop 722, which accommodates at least two portions of lace 120.

In an exemplary embodiment, lace 120 may be disposed through a trailing edge 906 of second exposed loop 722 and through a leading edge 908 of third exposed loop 724 to define a second eyestay 912. In an exemplary embodiment, trailing edge 906 of second exposed loop 722 and leading edge 908 of third exposed loop 724 are formed by folded regions in the continuous strip of material, as described above in reference to FIG. 4. In this embodiment, the folded regions associated with trailing edge 906 and/or leading edge 908 guide lace 120 at approximately an angle of 45 degrees on either side of second eyestay 912. In other embodiments, the folded regions associated with a leading edge and/or a trailing edge may guide a lace at an angle larger or smaller than 45 degrees.

In this embodiment, second exposed loop 722 is disposed removed from the distal end of lateral lacing element 116 in a direction towards heel region 14 of article 100. Accordingly, second exposed loop 722 may be configured to accommodate at least two portions of lace 120. As shown in FIG. 9, leading edge 904 of second exposed loop 722 contacts a portion of lace 120 and trailing edge 906 of second exposed loop 722 contacts a portion of lace 120. As a result, second exposed loop 722 may be associated with a run gap that is larger than the run gap associated with first exposed loop 720, which accommodates a single portion of lace 120.

In some embodiments, the width of eyestays, including first eyestay 910 and/or second eyestay 912 may be defined by the corresponding distance of a run gap of the secured loop that is disposed within the securing portion of lateral lacing element 116, as described in reference to FIG. 4 above.

In an exemplary embodiment, additional eyestays on lateral lacing element 116 and/or medial lacing element 118 may be arranged in a similar manner as described in reference to FIG. 9. Referring back to FIG. 8, exposed loops disposed on the distal end of medial lacing element 118, including sixth exposed loop 730, as well as exposed loops associated with the proximal end of lateral lacing element 116 and/or medial lacing element 118, including fifth exposed loop 728 and/or tenth exposed loop 738, also may be associated with smaller run gaps to accommodate a single portion of lace 120, as described in regards to first exposed loop 720.

In some embodiments, an article of footwear may include a lacing element that is configured with an extended loop disposed at the front and/or rear of the lacing element. In an exemplary embodiment, an extended loop may be disposed on a lacing element to anchor the end of the lacing element to an upper and to engage with a lace. With this arrangement, an extended loop may perform substantially the same function as an exposed loop and an anchor element, described above.

Figure 10:
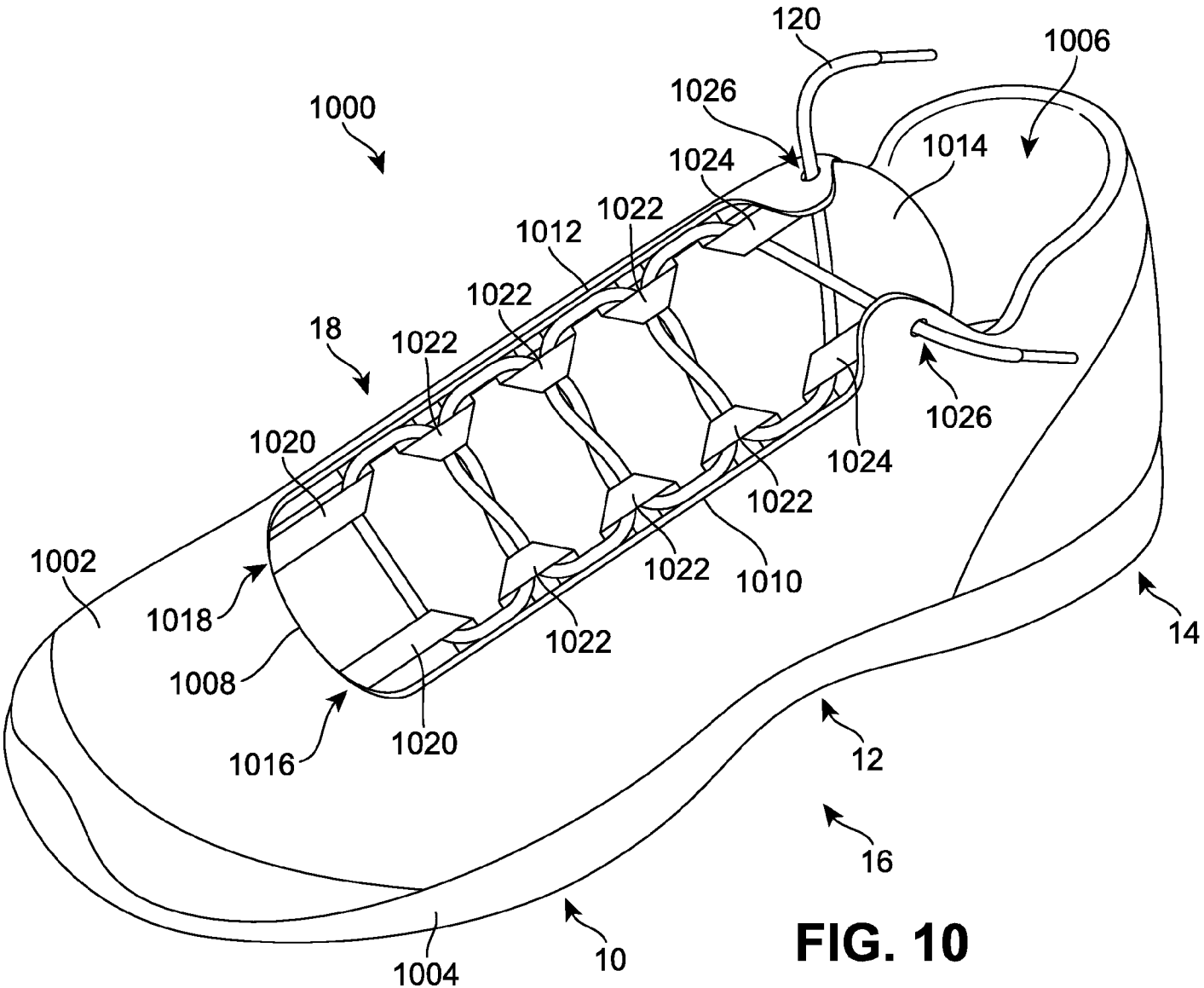
FIG. 10 is an isometric view of an article of footwear including a lacing element with an exemplary embodiment of an extended loop.
Figure 11:
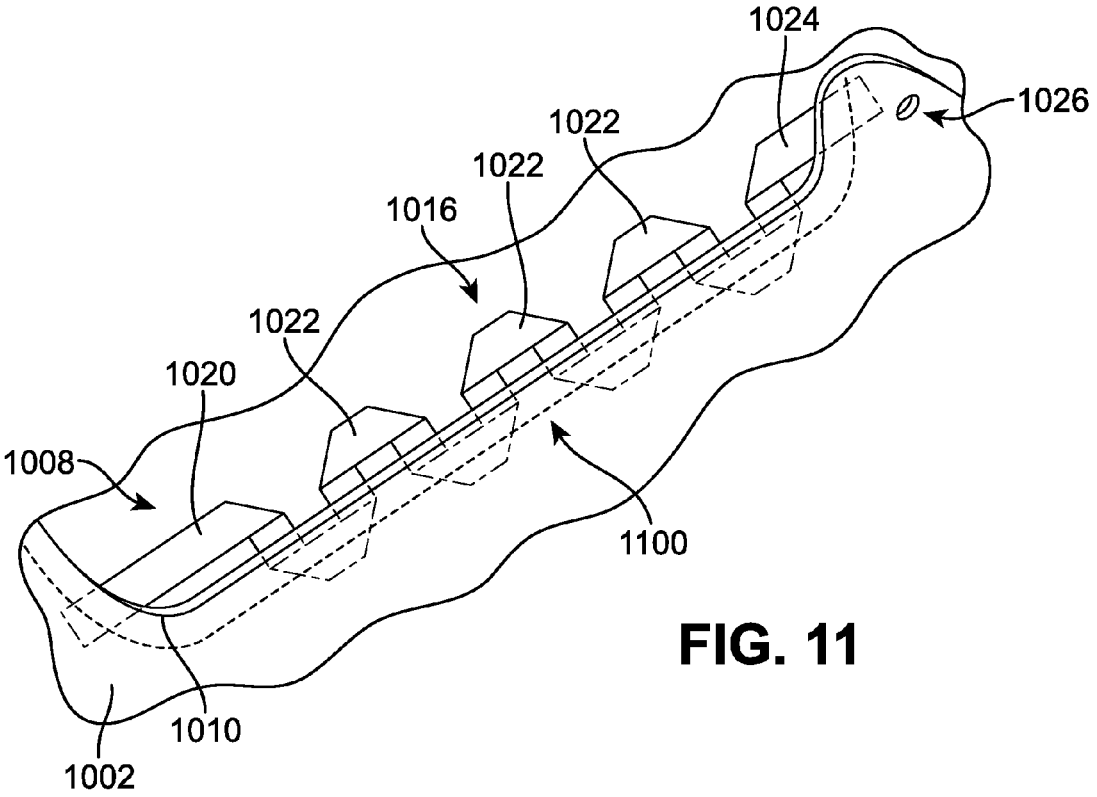
FIG. 11 is an enlarged view of a lacing element with an exemplary embodiment of an extended loop attached to an upper of an article of footwear.

Referring now to FIGS. 10 and 11, an article of footwear 1000 including lacing elements with extended loops disposed at the front and/or rear of the lacing element is illustrated. In an exemplary embodiment, article 1000 may be substantially similar to article 100, described above, and include one or more components associated with an article of footwear. In this embodiment, article 1000 includes an upper 1002 and a sole structure 1004. Upper 1002 and sole structure 1004 may be any type of upper and sole structure, including any type of upper and sole structure described above in reference to upper 102 and sole structure 104.

Additionally, article 1000 may further include an entry hole 1006 disposed near heel region 14 for receiving a foot of a wearer. Entry hole 1006 may be substantially similar to entry hole 106, described above. In an exemplary embodiment, article of footwear 1000 may include a fastening system configured to tighten upper 1002 around a foot of a wearer. In an exemplary embodiment, article of footwear 1000 includes a fastening system configured to be used with a lace. In this embodiment, article of footwear 1000 includes lace 120, described above, to secure a foot within upper 1002.

In order to fasten upper 1002, lace 120 may be configured to span a lacing gap 1008. In some embodiments, lacing gap 1008 may be substantially similar to lacing gap 108, described above. In different embodiments, lacing gap 1008 may be disposed in various locations on upper 1002. In an exemplary embodiment, lacing gap 1008 may be disposed between a lateral fastening portion 1010 associated with the lateral side portion of upper 1002 and a medial fastening portion 1012 associated with the medial side portion of upper 1002. In some embodiments, lateral fastening portion 1010 and/or medial fastening portion 1012 may include one or more provisions for associating with a fastening system. In an exemplary embodiment, one or more lacing elements may be associated with lateral fastening portion 1010 and/or medial fastening portion 1012. Lacing elements may be configured to attach to upper 1002 along lateral fastening portion 1010 and/or medial fastening portion 1012 and engage with a lace, including lace 120.

In some embodiments, article 1000 may be provided with a fastening system that includes one or more lacing elements associated with each of lateral side 16 and/or medial side 18 of upper 1002. In an exemplary embodiment, a lateral lacing element 1016 may be disposed along lateral fastening portion 1010 of upper 1002 and a medial lacing element 1018 may be disposed along medial fastening portion 1012 of upper 1002. In one embodiment, lateral lacing element 1016 and/or medial lacing element 1018 may be disposed along an edge of upper 1002 at lateral fastening portion 1010 and/or medial fastening portion 1012.

In some embodiments, lateral lacing element 1016 and/or medial lacing element 1018 may be provided with a plurality of folded loops 1022. In an exemplary embodiment, plurality of folded loops 1022 may be configured to engage with lace 120. In an exemplary embodiment, plurality of folded loops 1022 disposed on lateral lacing element 1016 and/or medial lacing element 1018 may be configured to tighten upper 1002 using lace 120. In one embodiment, folded loops 1022 may be substantially similar to folded loops 122, described above.

In an exemplary embodiment, lateral lacing element 1016 and/or medial lacing element 1018 may further include one or more extended loops disposed at the front and/or rear of the lacing element. In one embodiment, an extended loop may combine the function of an anchor element, described above, and an exposed loop. With this arrangement, an extended loop may be configured to anchor the end of lateral lacing element 1016 and/or medial lacing element 1018 to upper 1002 and to engage with lace 120. In one embodiment, an extended loop may be formed in a similar manner as an exposed loop, described above in reference to FIGS. 3 and 4. To form an extended loop, however, the strip of material is only folded across itself once at the beginning and/or end of the strip of material. For example, an extended loop could be formed from strip of material 302 shown in FIG. 3 using a similar process as shown for folding top end 306 across strip of material 302 to form fifth fold 316. By using a substantially similar process at the beginning and/or end of the strip of material, an extended loop may be included on the lacing element.

In an exemplary embodiment, each of lateral lacing element 1016 and/or medial lacing element 1018 may be provided with extended loops at the front and/or rear of the lacing element. As shown in FIG. 10, in this embodiment, lateral lacing element 1016 and/or medial lacing element 1018 include a front extended loop 1020 disposed at the front of lacing gap 1008 near forefoot region 10 of article 1000. Furthermore, lateral lacing element 1016 and/or medial lacing element 1018 also include a rear extended loop 1024 disposed at the rear of lacing gap 1008 near entry hole 1006 at heel region 14 of article 1000. With this arrangement, when lace 120 is pulled, lateral fastening portion 1010 and medial fastening portion 1012 may be brought closer to each other across lacing gap 1008, thereby tightening upper 1002.

In some embodiments, portions of upper 102 other than lateral fastening portion 1010 and/or medial fastening portion 1012 may include provisions to receive lace 120. In one embodiment, a portion of upper 1002 towards entry hole 1006 may include an eyelet 1026. In some embodiments, eyelet 1026 may be substantially similar to eyelet 124, described above. In addition, eyelet 1026 may be disposed in a similar location on both lateral side 16 and/or medial side 18 of upper 1002. With this arrangement, eyelet 1026 may secure lace 120 near entry hole 1006. In some embodiments, eyelet 1026 is optional and may be omitted.

In some embodiments, upper 1002 may further include one or more separate provisions configured to be associated with upper 1002. In some embodiments, upper 1002 may include a tongue 1014. Tongue 1014 may be substantially similar to tongue 114, described above. In an exemplary embodiment, a portion of tongue 1014 may be associated with upper 1002 adjacent to lacing gap 1008 near forefoot region 10 of article 1000. In this embodiment, a portion of tongue 1014 is fixedly attached to upper 1002 and is disposed within lacing gap 1008. In other embodiments, tongue 1014 may have other configurations, as described in reference to tongue 114.

Referring now to FIG. 11, an enlarged view of lateral lacing element 1016 with extended loops attached to portions of upper 1002 of article of footwear 1000 is illustrated. In this embodiment, lace 120 is not shown so that the details of the attachment of lateral lacing element 1016 to upper 1002 may be shown. In this embodiment, lateral lacing element 1016 includes front extended loop 1020 disposed at the front of lateral lacing element 1016. Front extended loop 1020 may be configured to attach to a portion of upper 1002 that is disposed in front of lateral fastening portion 1010. As shown in FIG. 11, front extended loop 1020 attaches lateral lacing element 1016 to upper 1002 at the front of lacing gap 1008. Similarly, rear extended loop 1024 may be configured to attach to a portion of upper 1002 that is disposed to the rear of lateral fastening portion 1010. As shown in FIG. 11, rear extended loop 1024 attached lateral lacing element 1016 to upper 1002 at the rear of lacing gap 1008. In this embodiment, rear extended loop 1024 attaches to upper 1002 near eyelet 1026. In other embodiments, however, rear extended loop 1024 may attach to upper 1002 at different locations.

In an exemplary embodiment, lateral lacing element 1016 may further include a securing portion having one or more secured loops that are associated with exposed loops 1022, described above. In one embodiment, the securing portion of lateral lacing element 1016 having one or more secured loops may be substantially similar to the securing portion of lateral lacing element 116, including one or more secured loops, described above.

Referring again to FIG. 11, in this embodiment, lateral lacing element 1016 is shown secured to upper 1002 along lateral fastening portion 1010. In an exemplary embodiment, lateral lacing element 1016 may be secured to upper 1002 using stitching 1100. Generally, stitching 1100 may be any kind of stitching that may be used to accomplish the attachment of lateral lacing element 1016 to upper 1002, including any kind of stitching described above in reference to stitching 500. In this embodiment, stitching 1100 is a running stitch.

In an exemplary embodiment, stitching 1100 may run across the securing portion of lateral lacing element 1016, including one or more secured loops. In addition, in this embodiment, stitching 1100 may continue along the contour of lacing area 1008 and run across the end of front extended loop 1020 at the front of lacing area 1008. Similarly, in this embodiment, stitching 1100 may extend up from the rear of lacing area 1008 to run across the end of rear extended loop 1024. With this arrangement, stitching 1100 attaches lateral lacing element 1016 on an inside of upper 1002 along lateral fastening portion 1010. In other embodiments, stitching 1100 may have different configurations, including any configuration described above in reference to stitching 500 and/or stitching 600.

In addition, while in the various embodiments described above a single lacing element formed from a continuous strip of material associated with each side of an article has been illustrated, it should be understood that in other embodiments, multiple lacing elements formed in a similar manner may be disposed on each side of an article. For example, a boot may be associated with multiple lacing elements along different portions of a lacing gap extending up the front of the article and above the ankle of a wearer. With this arrangement, lacing elements disposed at different portions of an article may be configured to provide support to a specific region of an article.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

an upper including a fastening portion;

a lacing element associated with the fastening portion;

a lace associated with the lacing element;

wherein the lacing element is made from a continuous strip of material that has been folded to form a plurality of folded loops;

wherein a trailing edge of a first folded loop and a leading edge of a second folded loop adjacent to the first folded loop form an eyestay configured to receive the lace; and wherein a first portion of the lace contacts the trailing edge of the first folded loop, a second portion of the lace contacts the leading edge of the second folded loop, and a third portion of the lace extends between the trailing edge of the first folded loop and the leading edge of the second folded loop, wherein the third portion of the lace is exposed.

2. The article of footwear according to claim 1, wherein the lacing element includes a plurality of eyestays.

3. The article of footwear according to claim 1, wherein the trailing edge and the leading edge are associated with folded regions of the continuous strip of material.

4. The article of footwear according to claim 3, wherein the folded regions are associated with an angle of approximately 45 degrees.

5. The article of footwear according to claim 3, wherein the trailing edge and the leading edge are associated with folded regions that are facing in opposite directions.

6. The article of footwear according to claim 1, wherein the trailing edge of the first folded loop and the leading edge of the second folded loop are separated by a distance associated with a third folded loop.

7. The article of footwear according to claim 6, wherein the lacing element is attached to the fastening portion of the upper at the third folded loop.

8. An article of footwear comprising:

an upper including a fastening portion;

a lacing element associated with the fastening portion;

wherein the lacing element is made from a continuous strip of material that has been folded to form a plurality of folded loops;

wherein an engaging portion of the lacing element is disposed above the upper;

wherein a securing portion of the lacing element is attached to the upper;

wherein the engaging portion and the securing portion comprise a substantially similar amount of the continuous strip of material;

wherein the engaging portion includes a first folded loop, wherein the first folded loop comprises a first folded region and a second folded region, wherein the first folded region and the second folded region are separated by a run gap disposed between the first folded region and the second folded region; and a lace associated with the engaging portion of the lacing element, wherein a first portion of the lace contacts the first folded region of the first folded loop and exits the first folded loop from the run gap, a second portion of the lace enters the first folded loop at the first run gap and contacts the second folded region of the first folded loop, so that the run gap accommodates two portions of the lace.

9. The article of footwear according to claim 8, wherein the engaging portion includes a plurality of exposed loops; and wherein the securing portion includes a plurality of secured loops, the plurality of secured loops having a substantially similar shape as the plurality of exposed loops.

10. The article of footwear according to claim 9, wherein the plurality of exposed loops and the plurality of secured loops have an approximately trapezoidal shape.

11. The article of footwear according to claim 10, wherein an adjacent pair of the plurality of exposed loops is separated by a distance that corresponds to a run gap associated with at least one secured loop located beneath the adjacent pair of exposed loops.

12. The article of footwear according to claim 8, wherein the securing portion of the lacing element is attached to the upper using stitching.

13. The article of footwear according to claim 8, wherein the securing portion includes a plurality of secured loops; and wherein each of the plurality of secured loops are attached to the upper.

14. The article of footwear according to claim 8, wherein the engaging portion includes a plurality of exposed loops; and wherein the lacing element includes at least one extended loop.

15. An article of footwear comprising:

an upper;

a lacing element comprising a continuous strip of material that has been folded to form a plurality of folded loops, the lacing element being configured to attach to the upper;

the lacing element including a first folded loop, the first folded loop comprising a first folded region and a second folded region of the strip of material separated by a first run gap associated with a first distance;

the lacing element including a second folded loop, the second folded loop comprising a third folded region and a fourth folded region of the strip of material separated by a second run gap associated with a second distance;

wherein the second distance is larger than the first distance;

wherein the second folded region is disposed adjacent to the third folded region, and wherein the second folded region is separated from the third folded region by a third run gap associated with a third distance; and a lace, wherein a first portion of the lace contacts the second folded region, a second portion of the lace contacts the third folded region, and a third portion of the lace extends between the second folded region and the third folded region, and wherein the length of the third portion of the lace is substantially equal to the third distance associated with the third run gap.

16. The article of footwear according to claim 15, wherein the first folded loop is adjacent to the second folded loop.

17. The article of footwear according to claim 15, wherein the lacing element further includes a third folded loop, the third folded loop comprising a fifth folded region and a sixth folded region of the strip of material separated by a third run gap associated with a third distance.

18. The article of footwear according to claim 17, wherein the third folded loop is disposed below the first folded loop and the second folded loop on the continuous strip of material.

19. The article of footwear according to claim 17, wherein an eyestay configured to receive the lace is defined by the second folded region of the first folded loop and the third folded region of the second folded loop; and wherein the eyestay has a width defined by the third distance associated with the third run gap of the third folded loop.

20. The article of footwear according to claim 15, wherein the first folded loop is configured to accommodate a single portion of the lace; and wherein the second folded loop is configured to accommodate at least two portions of the lace.

* * * * *